US010568367B2

(12) United States Patent
Hawkins-Whetstone

(10) Patent No.: US 10,568,367 B2
(45) Date of Patent: Feb. 25, 2020

(54) IMPACT REDUCING SPORTS BRA

(71) Applicant: SugarSports, LLC, Arlington, TX (US)

(72) Inventor: Patricia J. Hawkins-Whetstone, Arlington, TX (US)

( * ) Notice: Subject to any disclaimer, the term of this patent is extended or adjusted under 35 U.S.C. 154(b) by 0 days.

(21) Appl. No.: 15/727,502

(22) Filed: Oct. 6, 2017

(65) Prior Publication Data

US 2019/0104772 A1 Apr. 11, 2019

(51) Int. Cl.
*A41C 3/00* (2006.01)

(52) U.S. Cl.
CPC ..... *A41C 3/0057* (2013.01); *A41B 2400/60* (2013.01)

(58) Field of Classification Search
CPC ..... A41C 3/0057; A41C 3/00; A41C 1/00; A41C 1/02; A41C 1/0014; A41C 1/0064; A41C 1/0028
USPC ..... 450/1, 54–58, 64–74, 77, 79, 86, 30–33
See application file for complete search history.

(56) References Cited

U.S. PATENT DOCUMENTS 1,584,525 A * 5/1926 Freeman ..... A41C 3/00 24/697.2
2,498,487 A * 2/1950 Elias ..... A41C 3/06 450/78
4,444,191 A * 4/1984 Harned ..... A41C 3/0057 2/45
6,165,045 A * 12/2000 Miller ..... A41C 3/0057 450/1
6,755,717 B2 * 6/2004 Smith ..... A41C 3/0057 128/869
7,435,155 B2 * 10/2008 Reinisch ..... A41C 3/0028 450/59
7,909,675 B1 * 3/2011 Rainey ..... A41C 3/148 450/59
8,858,295 B2 * 10/2014 Thompson ..... A41F 15/002 450/10
9,192,197 B2 * 11/2015 Reinhard ..... A41C 3/02
2009/0081924 A1 * 3/2009 Puyaubreau ..... A41C 3/0057 450/39
2012/0045967 A1 * 2/2012 Punsal ..... A41C 3/0057 450/82
2013/0203319 A1 * 8/2013 Torres ..... A41C 3/0028 450/59
2013/0316616 A1 * 11/2013 Thompson ..... A41F 15/002 450/66
2015/0056890 A1 * 2/2015 Black ..... A41C 3/0057 450/86

* cited by examiner

*Primary Examiner* — Gloria M Hale
(74) *Attorney, Agent, or Firm* — Braxton Perrone, PLLC; Gregory Perrone; Bobby W. Braxton

(57) ABSTRACT

A sports bra with flexible reinforcements that aid in reducing inertia caused by movement of the breast weight when a person engages in physical activities.

18 Claims, 13 Drawing Sheets

IMPACT REDUCING SPORTS BRA

BACKGROUND OF THE INVENTION

Technical Field

The present invention relates to a sports bra with inner layer reinforcement that aids in reducing the inertia caused by the movement of breast weight when a person engages in a low, medium, or high impact physical activity, such as jogging, running, aerobic exercise, or participating in sports.

Description of Related Art

Women of all ages enjoy being physically active. Physical activity such as walking, running, and low and moderate aerobic exercises are beneficial to women's health. However, many activities, including jumping, various sports, and the like can cause movement of weight in a person's breast leading to "bounce" and additional discomfort for the person. Consequently, there is a need for a bra that reduces breast movement, reduces breast discomfort, and pain in the back, neck, clavicle, or other upper body areas, and mitigates potential physical problems caused by inertia inducing activities.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1A:
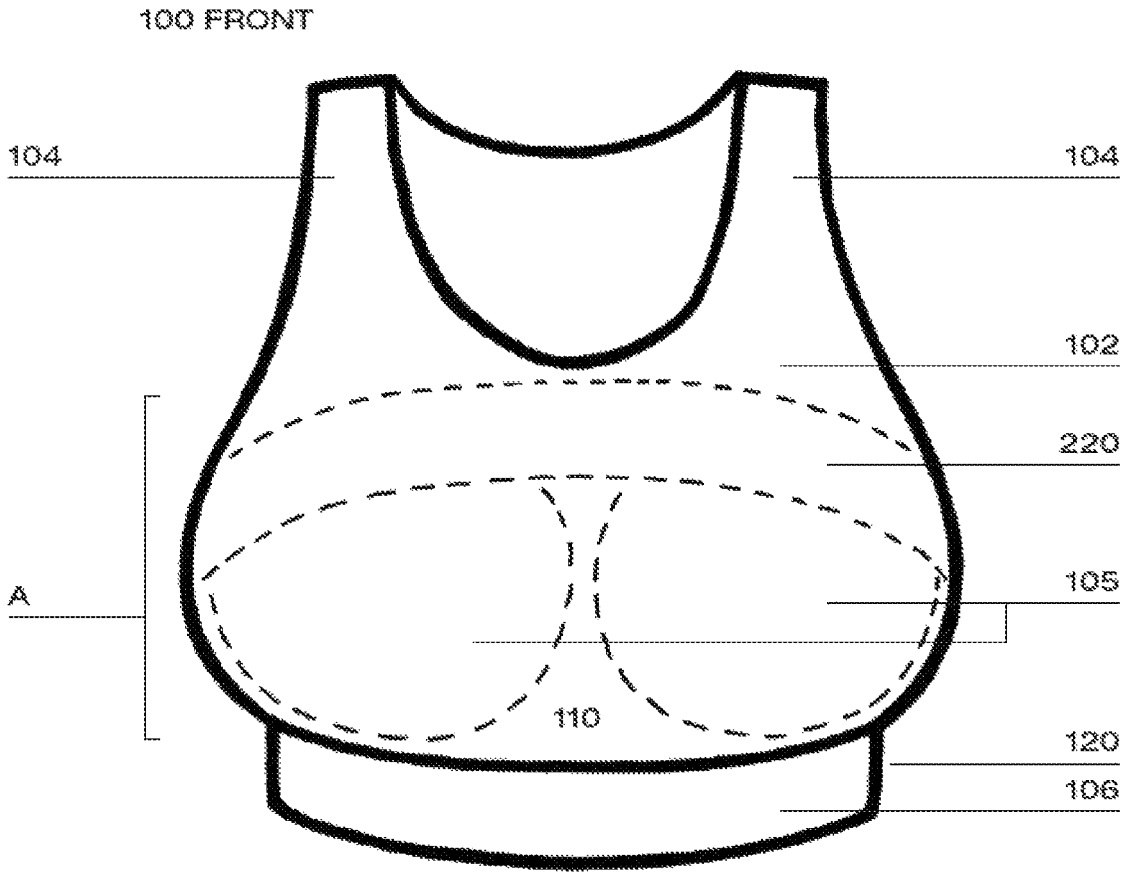
FIG. 1A is a perspective view of a front side of an embodiment of the presently described sports bra having an inertia neutralizing reinforcement.

FIG. 1A provides a front view of a sports bra according to the present disclosure. Sports bra 100 includes a main body region 102, shoulder straps 104 and rib cage band 106. Sports bra 100 is comprised of absorptive or wicking material, such as polyester, cotton, or a cotton blend. Sports bra 100 according to one embodiment is a standalone garment. That is, sports bra 100 can be worn separately from a garment in which it is integrated, such as a shirt, blouse, or tank top. As a standalone garment, sports bra 100 is worn much like a short tank top, a bikini top, or the like. In integrated fashion, a front panel of the garment covers sports bra 100 from view when the garment in which it is integrated is worn correctly. That is, the front panel of the garment covers the front of the sports bra and the back panel of the garment covers the back of the sports bra.

Sports bra 100 includes cup member 110 within main body region 102. Cup member 110 may simply be expanded material areas within main body region 102 that serve to compress the breasts without separation of each breast or may be encapsulation cups that separate or isolate each breast. Rib cage band 106 forms a bottom hem of sports bra 100. The structure of rib cage band 106 keeps sports bra 100 in place on and encircles the torso of the wearer beneath the breasts and prevents the bottom of sports bra 100 from riding up the torso while performing physical activity. Rib cage band 106 can also include or be composed of flexible or elasticized material that further prevents riding up the torso and provides a more secure fit. Rib cage band 106 can be a flat elastic band that also provides an upward force or support to counter the weight or downward inertia of the wearer's breasts caused during exercise.

Cup member 110 is disposed between an upper area of main body region 102 and rib cage band 106. That is, the height (referred to by the arrow A) of cup member 110 extends from the bottom edge of the upper area of main body region 102 down to the top edge of rib cage band 106. Cup member 110 can provide a desired shape or elevation of the breasts. In certain embodiments, cup member 110 can optionally include individual cups or encapsulating cups 105 to separate or isolate the breasts. The cups 105 can be attached or included in the cup member 110. In embodiments that include cups 105, the cups are disposed between the front inner layer and the front outer layer, as discussed below.

As shown in FIG. 1A, rib cage band 106 is disposed beneath the cup member 110. Rib cage band 106 can be positioned in physical contact with the bottom of the wearer's breasts. For example, as depicted in the cross-sectional view of FIG. 1C, the rib cage band 106 can be enclosed within a channel 120 in a lower area of main body region 102 of sports bra 100. Channel 120 in sports bra 100 can include a fold along the entire bottom edge of the sports bra 100 and includes a seam 122 along the top edge of channel 120, such that around the circumference of the sports bra, the upper edge of rib cage band 106 is in contact with seam 122 along the top edge of channel 120. The bottom edge of the cup member 110 can be stitched or otherwise fixed in contact with the seam 122 along the top edge of the channel 120.

Figure 1B:
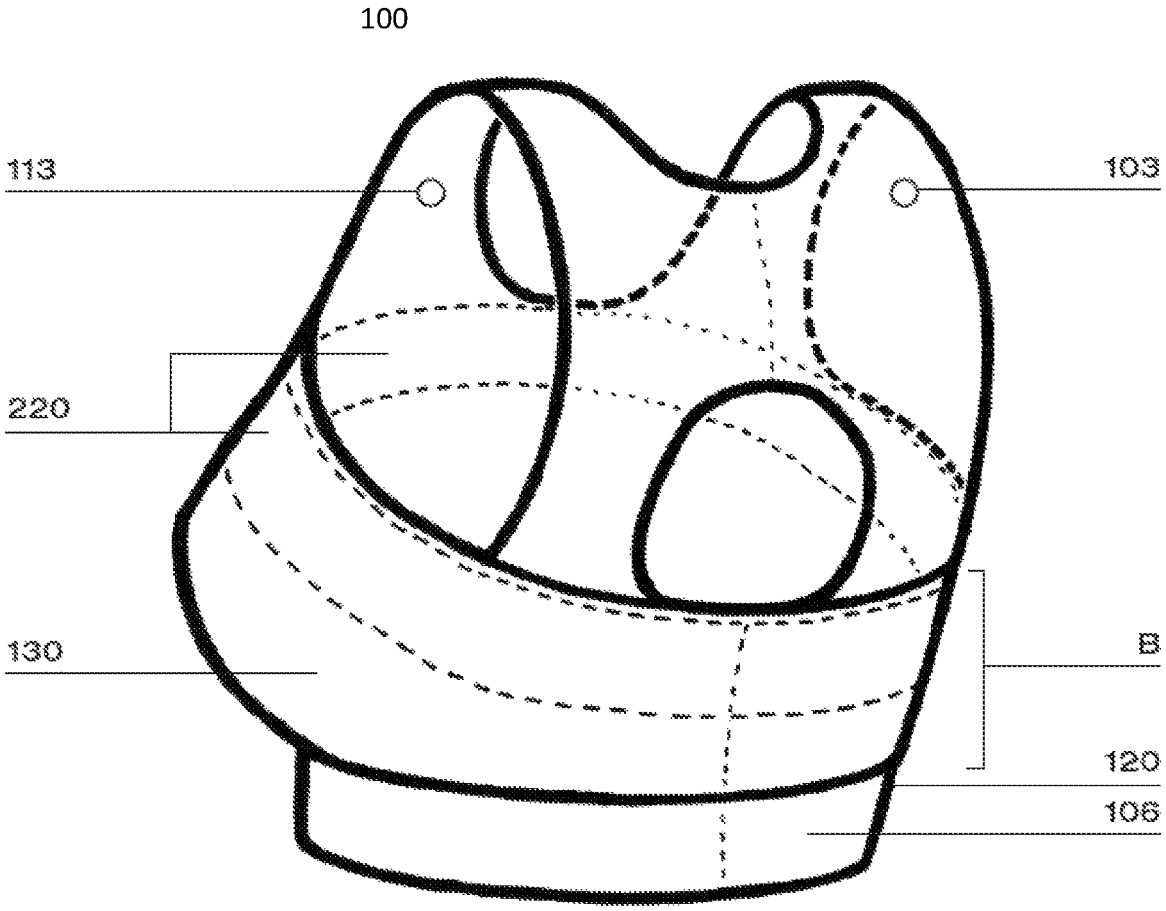
FIG. 1B is a perspective view of a back side of an embodiment of the presently described sports bra having an inertia neutralizing reinforcement.

In one embodiment, the sports bra 100 has the brand name on the front center of the sports bra 100, on the front or back areas of rib cage band 106 of sports bra 100. FIG. 1B depicts the back of the sports bra. As shown, rib cage band 106 encircles or defines the circumference of the sports bra 100 around its longitudinal or y-axis and extends from the front to the back of the bra.

Height B, shown in FIG. 1B, is defined by the height in the back of sports bra 100 of the rearward main body portion 130 from the top edge of rib cage band 106 to the upper edge of rearward main body portion 130. The difference in height A of the front of the sports bra 100 and height B in the back of the sports bra will vary according to the cup 105 size or cup member 110 size of the sports bra 100. Larger sized bras will typically have larger cup 105 or cup member 110 sizes that in turn, result in greater height A, and a greater difference between height A and height B. Conversely, smaller cup 105 or cup member 110 size will have a smaller height A and in turn a smaller difference between height A and height B. As shown in the rear view of sports bra 100 of FIG. 1B, arm openings 103 and 113 allow the wearer to don sports bra 100 by placing an arm through each opening.

Inertial neutralizing reinforcement 220 can be integral to, attached to, or paired with a single layer, under a single layer, on top of a single layer, contained within multiple layers, or be its own element with no "carrier" layer.

Figure 5A:
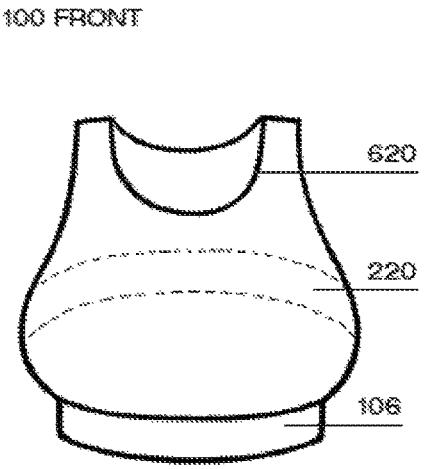
FIG. 5A depicts a perspective view of an embodiment of the presently described sports bra having an inertia neutralizing reinforcement.
Figure 5B:
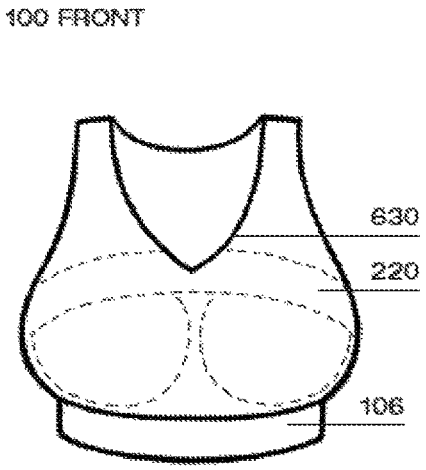
FIG. 5B depicts a perspective view of an embodiment of the presently described sports bra having an inertia neutralizing reinforcement.
Figure 5C:
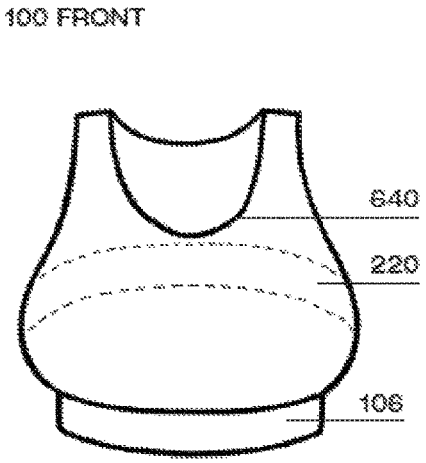
FIG. 5C depicts a perspective view of an embodiment of the presently described sports bra having an inertia neutralizing reinforcement.
Figure 5D:
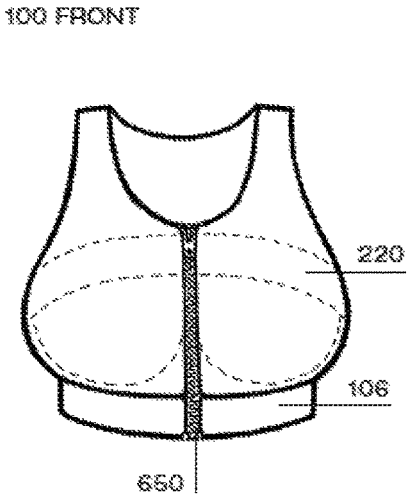
FIG. 5D depicts a perspective view of an embodiment of the presently described sports bra having an inertia neutralizing reinforcement.

FIGS. 5A, 5B, 5C, and 5D, depict examples of the different shapes of the front of sports bra 100. In one embodiment, the top of the sports bra 100 can have a neck line that is, a V-neck shaped top 630 (FIG. 5B), a circular top 620 (FIG. 5A), a crew neck 640 top (FIG. 5C), a spaghetti strap top (not shown), or a crisscross top (not shown). The neck line allows the user to put the sports bra on by placing the sports bra over her head. The sports bra 100 straps (104 of FIG. 1A) form two openings or arm holes. As shown in FIG. 5D, sports bra 100 having any shape or style top can include a zipper 650 to serve as the fastener joining the two halves of sports bra 100 when worn.

Figure 2A:
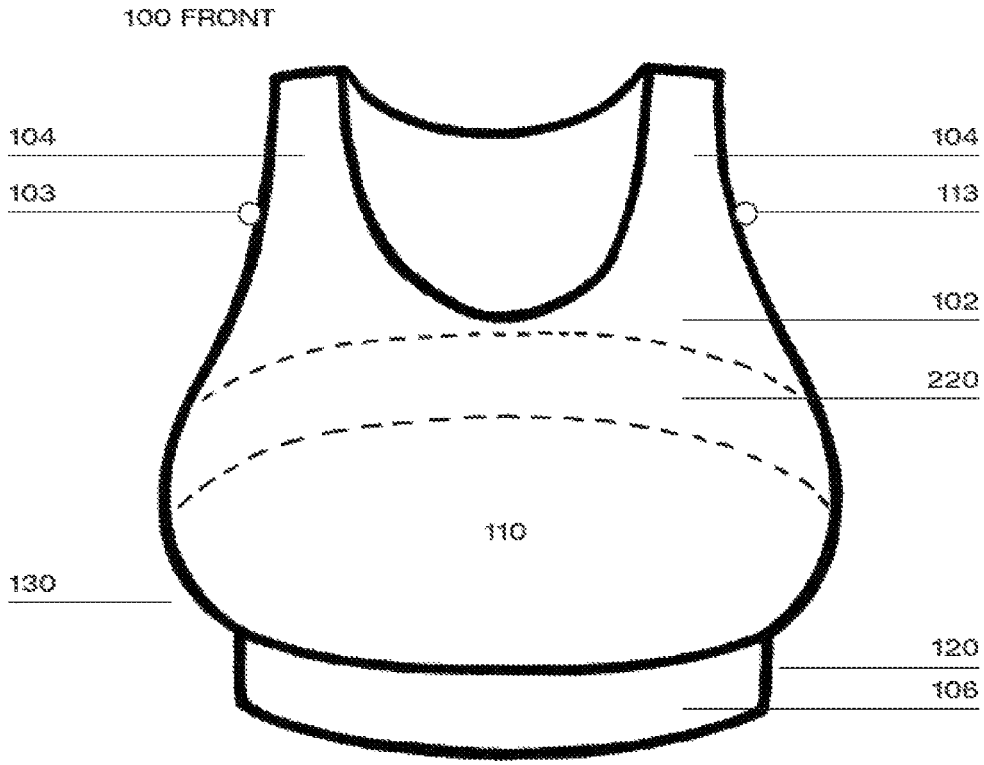
FIG. 2A is a perspective view of a front side of an embodiment of the presently described sports bra having an inertia neutralizing reinforcement.

FIG. 2A depicts a sports bra including an inertia neutralizing reinforcement that reduces shock according to an embodiment of the present disclosure. Inertia neutralizing reinforcement 220 encircles the upper torso of the wearer above the breasts. Inertia neutralizing reinforcement 220 is composed of a flexible material that encircles the wearer's torso front to back, and in the front at the top mid area of breast tissue or mid-thorax region. For example, the flexible material can be a flat elastic band, lycra, spandex, or any suitable flexible material. Inertia neutralizing reinforcement 220 can also take the form of a stitch weave that is integrated into the sports bra fabric, a gel bladder or other flexible material. Inertia neutralizing reinforcement 220 provides a downward force to counteract the upward inertia or momentum of the breast weight during exercise. In certain embodiments, inertia neutralizing reinforcement 220 and rib cage band 106 work together to apply sufficient pressure or resistance to prevent primarily vertical displacement of breast tissue during low to high impact exercise. Greatly reducing vertical displacement or bounce of breast weight provides enhanced comfort to the wearer. As shown, in one embodiment, inertia neutralizing reinforcement 220 can be positioned across the top edge of the main body portion 102 of sports bra 100, which is occupied by the wearer's breast tissue. This location of inertia neutralizing reinforcement 220 provides control in a downward direction that is not provided by the cups 105 (FIG. 1A) that alone only encapsulate each corresponding breast or cup member 110 that alone simply compresses the breasts. In certain embodiments, the inertia neutralizing reinforcement 220 is of sufficient resistance or tension to restrict the wearer's breast tissue so as to restrict or reduce upward breast movement during activity. In other embodiments, the inertia neutralizing reinforcement 220 is of less resistance allowing limited upward movement.

Inertia neutralizing reinforcement 220 can be an elastic continuous band of any color. Inertia neutralizing reinforcement 220 can vary in width, in one embodiment, the minimum width can be between one-half inch to three inches. Narrower or wider straps may be used. Additionally, multiple top inertia neutralizing reinforcement 220 can also be used. Top inertia neutralizing reinforcement 220 extends on top of the breast when the bra is worn and extends from underneath the left arm to the area underneath the right arm.

In some embodiments, top inertia neutralizing reinforcement 220 is a band of flexible material situated in an approximate straight line across the upper area of main body portion 102 of sports bra 100. That is, inertia neutralizing reinforcement 220 runs straight across the wearer's mid-thorax above the breasts. Alternatively, as shown in FIG. 2A, inertia neutralizing reinforcement 220 includes flexible material having a slightly arched shape such that inertia neutralizing reinforcement 220 is arranged across the upper area of main body area 102 of sports bra 100 but lower at the left and right sides of the front of the torso (or to the sides of the breasts) in relation to the center of the front torso above the breasts. In such an arrangement, the right side of the inertia neutralizing reinforcement 220 is disposed below the right armhole 103 of sports bra 100 and the left side of the inertia neutralizing reinforcement 220 is disposed below the left armhole 113 of sports bra 100.

In addition, rib cage band 106 can have a slightly arched shape such that the sides of the bottom rib cage band 106 are situated above the center of the rib cage band 106. The center of the bottom rib cage band 106 and the center of the inertia neutralizing reinforcement 220 can be collinear with a vertical axis of the sternum of the wearer. The sternum is commonly referred to as the breastbone between the ribs.

Figure 2B:
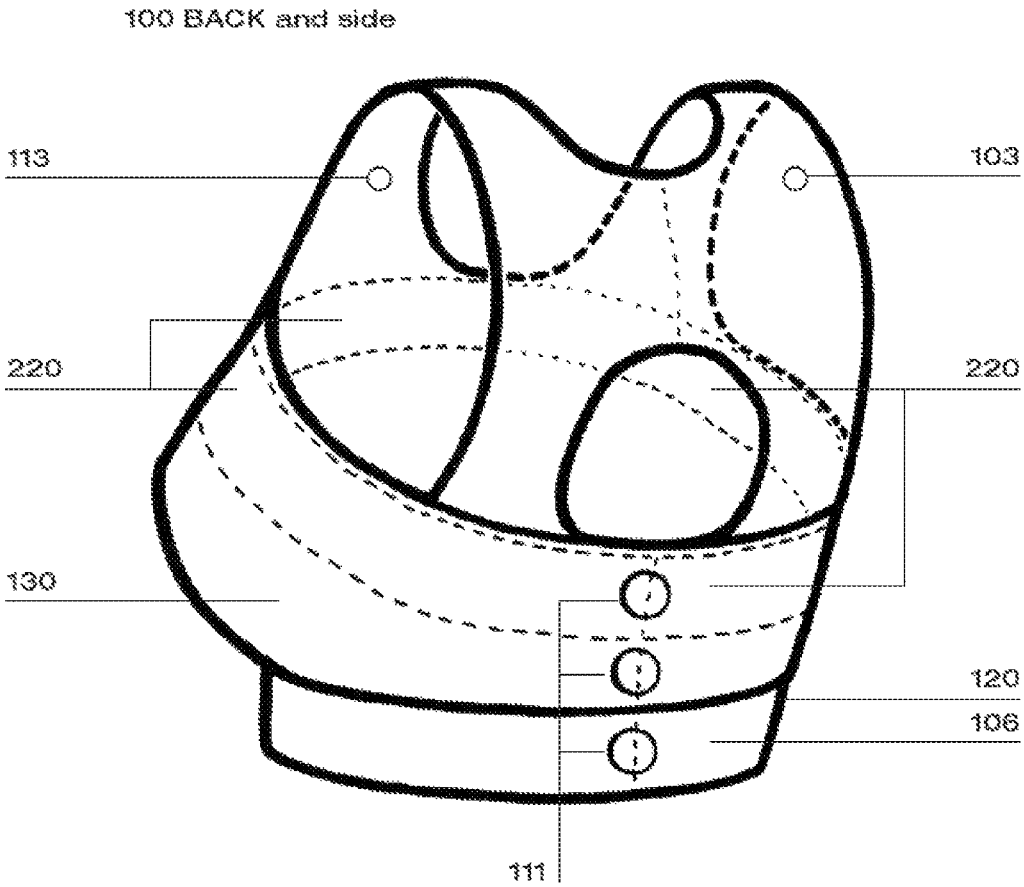
FIG. 2B is a perspective view of a back side of an embodiment of the presently described sports bra having an inertia neutralizing reinforcement.

FIG. 2B depicts the back of sports bra 100 depicted from the front in FIG. 2A. As shown in FIG. 2B, inertia neutralizing reinforcement 220 extends from the front of sports bra 100 primarily in the upper area of the main body region 102 to and around the rearward main body portion 130 of sports bra 100. In this arrangement, inertia neutralizing reinforcement 220 defines the circumference of or encircles the torso from above the breasts in the front of sports bra 100, under the wearer's arms occupying arm holes 103 and 113, to the mid-back area in the back of sports bra 100. This configuration provides enhanced control beyond traditional compression or encapsulating sports bras and enables heightened reduction of inertia and corresponding vertical displacement of the breast tissue during exercise or activity. In this "high to low" arrangement, inertia neutralizing reinforcement 220 can be a continuous band of flexible, elasticized material as discussed above. In the alternative, inertia neutralizing reinforcement 220 can be a non-continuous length or multiple pieces or lengths of flexible, elasticized material, with inertia neutralizing reinforcement 220 spanning across the front of the torso, above the breasts, beneath the arms, with each end of the length of band extending around the back of sports bra 100 and meeting, or approximately meeting at the middle back area within the rearward main body portion 130. Each end of the length of band may be sewn or otherwise adhered into the rearward main body portion 130.

In one embodiment, the sports bra 100 is worn by the user by stretching the sports bra 100 over the individual's head and pulling it on. In another embodiment, the sports bra 100 contains fasteners 111 on the back of the sports bra 100. Fasteners 111 may include, but are not limited to a zipper, buttons, hooks, or Velcro. Fasteners 111 may be in the center back of sports bra 100 or under one of the arm holes. Fasteners 111 may be aligned in a straight line on the back of the bra, or in a different angle or shape, such as but not limited to a diagonal. The sports bra 100 may contain no fasteners 111 or one or more fasteners 111 as an aid for the user to wear the sports bra.

Figure 1C:
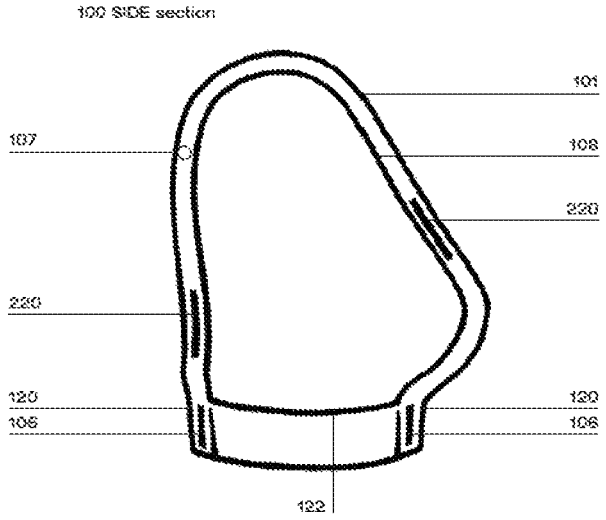
FIG. 1C is a cross-sectional view of an embodiment of the presently described sports bra having an inertia neutralizing reinforcement.

FIGS. 1A, 1B and 1C, illustrate sports bra 100. In one embodiment, sports bra 100 contains multiple layers. These layers can be made of material that absorbs body moisture. Compression material allows sports bra 100 to stretch allowing for movement as the user is physically active. The sports bra 100 contains an outer visual layer 101, a middle construction layer (or shock layer) 107, and an interior or next-to-skin layer 108, as seen in FIG. 1C. The outer visual layer 101 is the layer of the sports bra 100 that is visible when sports bra 100 is worn. The outer layer 101 can be made of fabrics of different colors and designs, can be solid, patterned or textured fabric, and can be dyed or ornamented with graphics. The outer layer 101 can include the brand of the sports bra manufacturer or any commercial association making the brand name or commercial associate name visible when the sports bra 100 is worn.

The next-to-skin layer 108 is the layer that touches the user's skin. The next-to-skin layer 108 is the inner most layer, placed closest to the skin. In one embodiment, the next-to-skin layer is composed of soft, moisture absorbing material. This layer can be composed of any wearable material. The next-to-skin layer 108 extends through the inner side of the sports bra 100. Use of fabric that absorbs moisture allows the fabric to pick up perspiration that is released from the body.

Sports bra 100 depicted in FIGS. 1A, 1B, 2A, and 2B can be of a multi-layered construction. In one embodiment, sports bra 100 is comprised of three layers. A first interior layer of sports bra 100 comes into direct contact with the skin or separate garment worn by the wearer when sports bra 100 is donned. This "next-to-skin" layer is similar to a lining and may be comprised of a variety of materials known in the art to achieve optimal comfort and absorption. The second or middle layer removed from the skin of the wearer and outside of the interior layer is a construction layer (shock layer). The shock layer 107 can include cups 105, and inertia neutralizing reinforcement 220 in an arrangement such as one of those described above. FIGS. 1A, 1B, 2A, and 2B depict the structural pieces of sports bra 100 that can comprise this shock layer 107. That is, the structural components of sports bra 100 are exposed in these figures.

When placed between the next-to-skin layer and outer layer, the structural component or shock layer can include cups within the inner layer to provide control and desired shape or elevation of the breast. Cups 105, if used, can be permanently or removably attached to the inner layer. Cups 105 can vary in size depending on the breast size of the wearer. Cup 105 sizes range, but are not limited to sizes A to H and can be flat, rounded, conical, rocket, square, trapezoid, or oval in shape. Top inertia neutralizing reinforcement 220, as described, also resides within the middle or shock layer 107 to provide additional control and reduce or restrict vertical displacement of the breast weight caused by inertia resulting from activities of the wearer.

The outer visible layer 101 (e.g., FIG. 1C), hides from view the middle construction or shock layer of sports bra 100. The outer visible layer 101 spans the front and back of sports bra 100. The back of sports bra 100 includes the back of the top of inertia neutralizing reinforcement 220, the hack of the rib cage band 106, and rearward main body portion 130. The outer visible layer hides from view the inertia neutralizing reinforcement 220, rib cage band 106, and cups 105 that can be included as part of the sports bra construction.

The interior, next-to-skin, and outer visible layers of rearward main body portion 130 of sports bra 100 comprise a material that wicks moisture away from the skin to hasten evaporation and contribute to cooling. Unlike the wearer's front torso, the back of the torso of the wearer is relatively flat. Accordingly, less fabric is needed to cover the wearer's back, particularly when stretchable material is used.

In certain embodiments, the rearward main body portion 130 back band includes an "infinity" symbol pattern bound by a concavely arched back portion of the top inertia neutralizing reinforcement 220 and a convexly arched back portion of rib cage band 106. In certain embodiments rearward main body portion 130 includes a rectangular shape bound on the top and on the bottom by a straight back portion of the inertia neutralizing reinforcement 220 and a straight back portion of rib cage band 106, respectively.

In certain embodiments, sports bra 100 does not include rearward main body portion 130. For example, the bottom edge of the inertia neutralizing reinforcement 220 is immediately coupled to the top edge of rib cage band 106, resulting in a much narrower area of sports bra 100 covering the back of the wearer horizontally.

The portion of inertia neutralizing reinforcement 220 that extends to the back of sports bra 100 contributes to the downward pressure across the top of the breast tissue (and in turn preventing vertical breast motion) by stretching to the wearer's back. The inertia neutralizing reinforcement 220 stretches from the one side of the main body area 102 in the front to the other side, while passing under the left armhole 113 and under the right armhole 103. Inertia neutralizing reinforcement 220 can comprise a single continuous band of flexible material that forms a round band.

Alternatively, as discussed, the inertia neutralizing reinforcement 220 can be comprised of multiple bands of flexible material coupled to each other to form a round band. For example, a front portion of the inertia neutralizing reinforcement 220 can be stitched to the back portion of inertia neutralizing reinforcement 220 at the seams below the armholes. The back portion of inertia neutralizing reinforcement 220 further contributes to the downward pressure across the top of the breast tissue by anchoring the front portion of the inertia neutralizing reinforcement 220. The back portion of inertia neutralizing reinforcement 220 can be more rigid or less flexible than the front portion of the inertia neutralizing reinforcement 220.

The back portion of rib cage band 106 also contributes to the upward pressure across the bottom of the breast tissue by stretching across the wearer's back. The back portion of rib cage band 106 stretches from the one side of the sports bra 100 to the other side, such as from under the left armhole to under the right armhole. Rib cage band 106 can be a single continuous band of flexible material that forms a round band. Rib cage band 106 can be comprised of multiple bands of flexible material coupled to each other or pieced together to form a round band. For example, a front portion of rib cage band 106 can be stitched to the back portion of rib cage band 106 at the side seams below the armholes. The back portion of rib cage band 106 further contributes to the upward pressure across the bottom of the breast tissue by anchoring the front portion of the rib cage band 106. Back portion of rib cage band 106 can be equally or less flexible than the front portion of rib cage band 106.

Figure 3A:
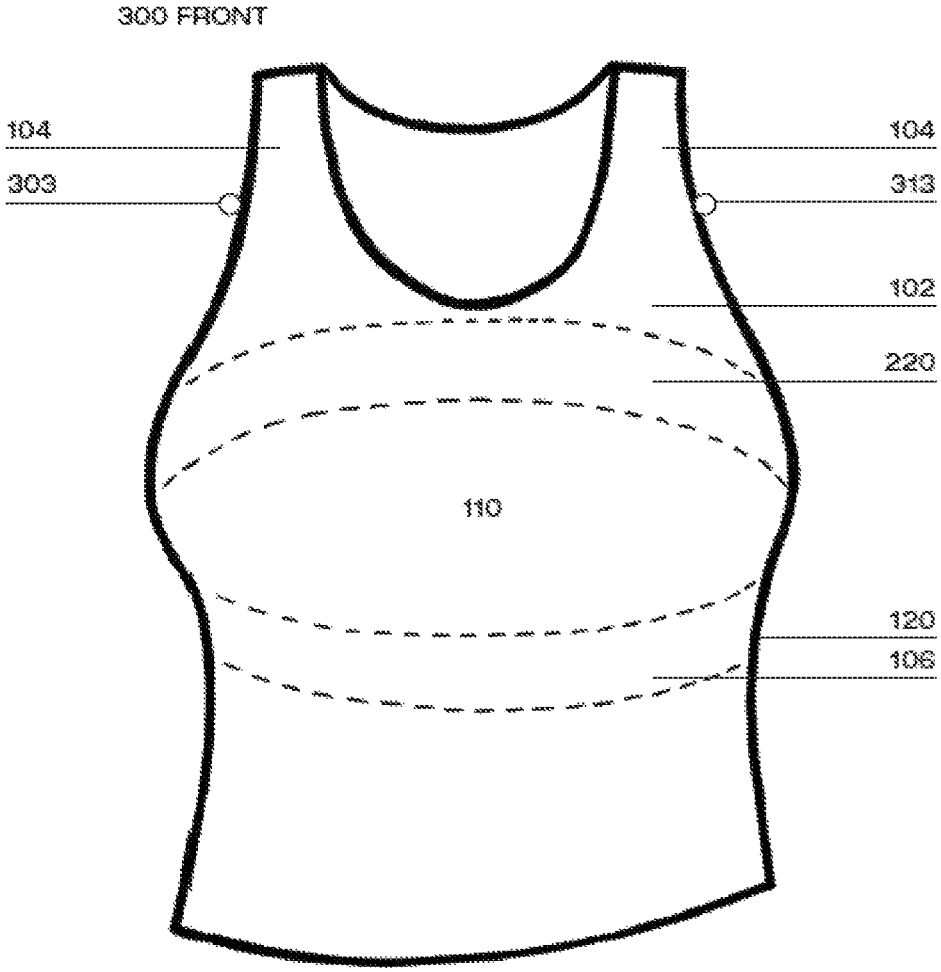
FIG. 3A depicts a front view of a garment in which an embodiment of the presently described sports bra, having an inertia neutralizing reinforcement, is incorporated.
Figure 3B:
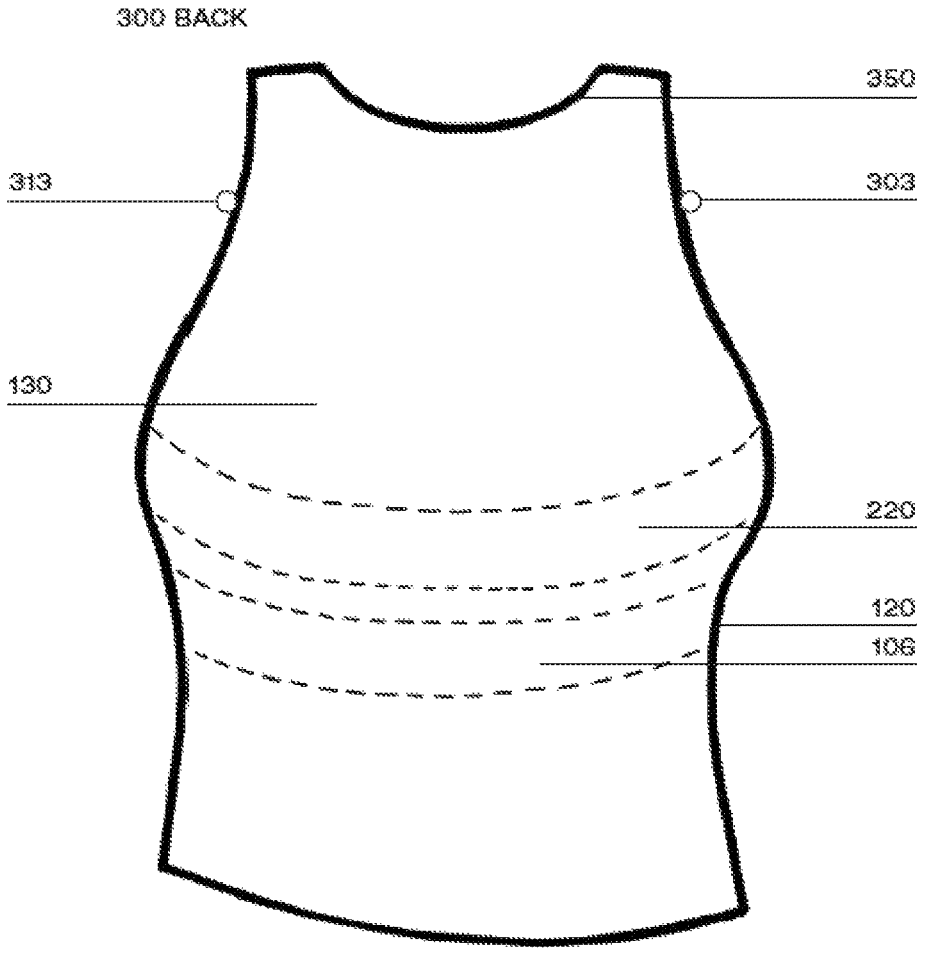
FIG. 3B depicts a rear view of a garment in which an embodiment of the presently described sports bra, having an inertia neutralizing reinforcement, is incorporated.

FIGS. 3A and 3B depict the front and back views of a tank top 300 that includes integrated sports bra 100. In FIGS. 3A and 3B, integrated sports bra 100 is hidden from view, covered by the outer visual layer and having an interior "next-to-skin" layer that is in direct contact with the wearer, as discussed above with respect to the multi-layer construction of the presently described sports bra. Depicted in FIGS. 3A and 3B by dashed lines are the components of the shock layer of sports bra 100 described above that are integrated into tank top 300 and hidden from view. In FIG. 3A, front of tank top 300 has disposed between the outer visual layer and the interior next-to-skin layer the various components of sports bra 100 previous described in connection with the previous figures. Within the front layer of tank top 300 are cup member 110 that can include cups 105 within the main body area 102. Underneath main body area 102 is inertia neutralizing reinforcement 220 that provides control from above the breasts to prevent vertical displacement due to inertia as described. Inertia neutralizing reinforcement 220 wraps around the upper torso of the wearer in the front, passes beneath arm holes 303 and 313 and into the rearward main body portion 130 within the back of the interior and outer visual layers of tank top 300.

Beneath rearward main body portion 130 is the back portion of rib cage band 106. Rib cage band 106 can be a continuous loop that encircles the lower portion of the wearer's torso at the front and back of tank top 300. In this arrangement, within the interior and outer visual layers of tank top 300, a garment such as tank top 300 provides the vertical displacement prevention properties of sports bra 100 within a single garment. This integrated sports bra 100 provides the same level of control and vertical displacement restriction of the breast weight as does sports bra 100 as a standalone garment, while providing more coverage to those wishing to wear only a single garment. When tank top 300 is worn correctly, the structural components are not visible. The back of tank top 300 in FIG. 3B includes the back of rib cage band 106 and the back portion of inertia neutralizing reinforcement 220. As described, rib cage band 106 keeps sports bra 100 from riding up the torso during exercise. The garment into which sports bra 100 is integrated in FIGS. 3A and 3B is referred to as a "tank top", but the description above is equally applicable to any shirt or dress into which sports bra 100 may be integrated.

Tank top 300 can be a variety of lengths, hitting below the hips, hitting above the hips, or hitting at the user's waist. In one embodiment, the sports bra 100 is included in tank top 300, however a sports bra does not require a tank top. Tank top 300 includes all layers of the sports bra, the outer layer 101, shock layer 107, and next-to-skin layer 108, and the cross-sectional view of FIG. 1C in this regard is applicable here. Tank top 300 consists of a neck line 350 and two arm holes 303 and 313. The present disclosure does not limit the sports bra 100 to use with a tank top, rather discloses the sports bra 100 as a garment of its own. In one embodiment, the attached sports bra 100 is the same color as the tank top. In another embodiment, the sports bra 100 may be a different color or design than the tank top.

Figure 4A:
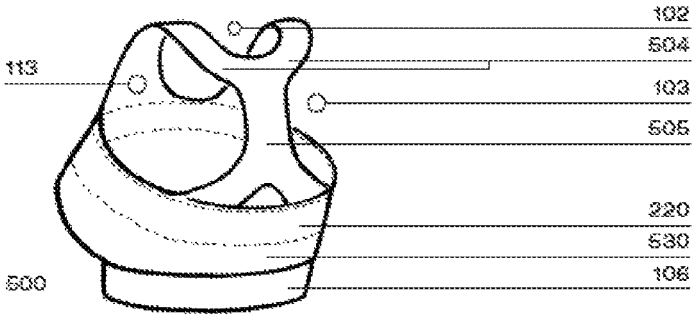
FIG. 4A is a perspective view of the back of a racer back style sports bra having an inertia neutralizing reinforcement.
Figure 4B:
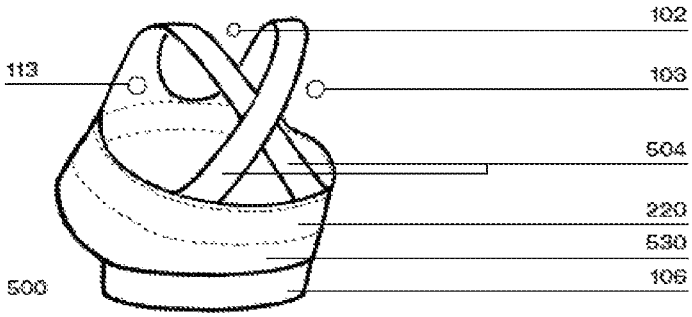
FIG. 4B is a perspective view of the back of a crisscross back style sports bra having an inertia neutralizing reinforcement.
Figure 4C:
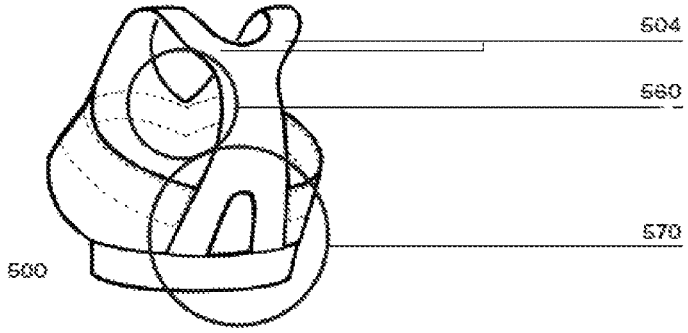
FIG. 4C is a perspective view of the back of a racer back style sports bra having an inertia neutralizing reinforcement.

FIGS. 4A, 4B, and 4C depict the back of a tank top style or racer back sports bra 500 that includes a crisscross style structure according to an embodiment of the present disclosure. Tank top style sports bra 500 shown from the back in FIG. 4A with back connectivity of the sports bra straps 504, back area 505 and rearward main body area 530 in what is referred to as a racer back design. This design lends itself to incorporation of the back section of inertia neutralizing reinforcement 220 in a crisscross arrangement in back as shown in FIG. 4B. Back portion of inertia neutralizing reinforcement 220 that extends across the rearward main body area 530 of racer back bra 500. This is a similar arrangement as described in connection with other embodiments. In addition to, or in lieu of, the inertia neutralizing reinforcement 220 extends laterally across rearward main body area 530 of racer back bra 500, the same or similar type of flexible material may be disposed within straps 504 in a crisscross arrangement. As described, inertia neutralizing reinforcement 220 can be contiguous, continuous, or pieced; free of shape or forming a shape 560 as shown in FIG. 4C. Also, inertia neutralizing reinforcement 220 can encircle the body or terminate under or behind the wearer's arms or shoulder blades, as shown in highlighted area 570 of FIG. 4C. Inertia neutralizing reinforcement 220 can also be permanently fastened to the remainder of sports bra 100 or can be removable (see FIG. 8, for example).

Straps 504 of sports bra 500 in FIG. 4C extend over the shoulder and towards the back of sports bra 500. Straps 504 extend over each respective shoulder and around the neck to the back. The back of sports bra 500 can be shaped in a variety of ways, including but not limited to a crisscross (see FIG. 4B), a solid back, a racer back (for example FIG. 4A), and multi straps. The back of the sports bra 500 may be the same color as the front of the sports bra 100 or may be in a different color.

Further, as shown in FIG. 4C, the arrangement of inertia neutralizing reinforcement 220 can continue to the front of racer back bra 500 according to another embodiment of the present disclosure. This arrangement may be provided in addition to, or in lieu of, the full torso encircling inertia neutralizing reinforcement 220 situated above the breasts as described in detail regarding the several embodiments above. For larger breasted individuals or those participating in the highest impact activities, thus, causing the most breast weight inertia, the crisscross arrangement augmenting the laterally positioned inertia neutralizing reinforcement 220 above the breasts provides additional inertia offset capability. Sports bra 500 can have a cutout on the back area taken from material covering the wearer's back. The cut out may be located in the center of the sports bra back, near the bottom of the bra (FIG. 4C), or near the top. The cut out may be any shape, including but not limited to an oval shape, round shape, rectangular shape, or star shaped.

Figure 6A:
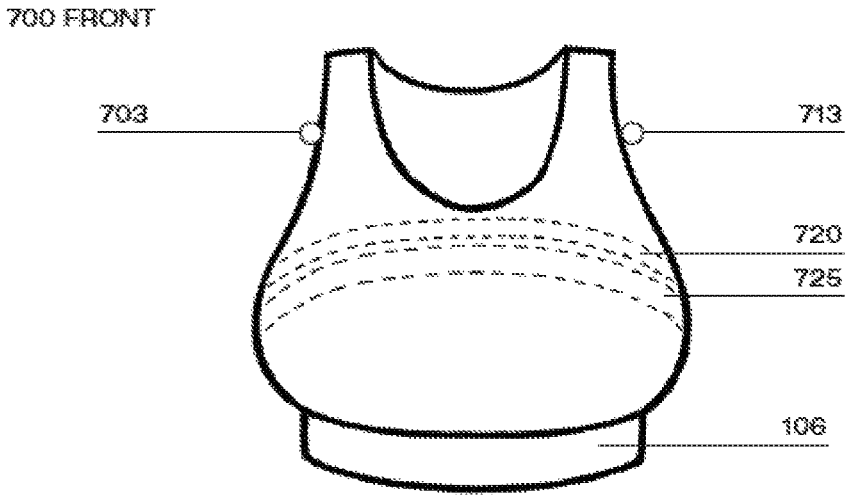
FIG. 6A depicts a perspective view of an embodiment of the presently described sports bra having multiple inertia neutralizing reinforcements.

In another embodiment, depicted in FIG. 6A, sports bra 700 includes a first top-crossing member 720, and a second top-crossing member 725. The top-crossing members 720 and 725 are composed of a flexible material and can be a flat elastic band, lycra, spandex, or any suitable flexible material. Top-crossing members 720, 725 provide a downward force to counter the upward inertia or momentum of breast weight during exercise. The right side of the top-crossing members 720, 725 is disposed below and behind the right armhole 703 of the sports bra 700, and the left side of the top-crossing members 720, 725 is disposed below and behind the left armhole 713 of sports bra 700. In some embodiments, the top-crossing members 720, 725 and rib cage band 106 work together to apply enough pressure to prevent bounce of breast tissue from exercise. Eliminating bounce of breast tissue provides comfort to the wearer. The top-crossing members 720, 725 prevents the discomfort associated with the momentum of breast tissue during exercise by applying a downward pressure. That is, top-crossing members 720, 725 can be positioned across the top area of wearer's breast tissue to provide control in a direction that is not provided by cups 105.

Figure 6B:
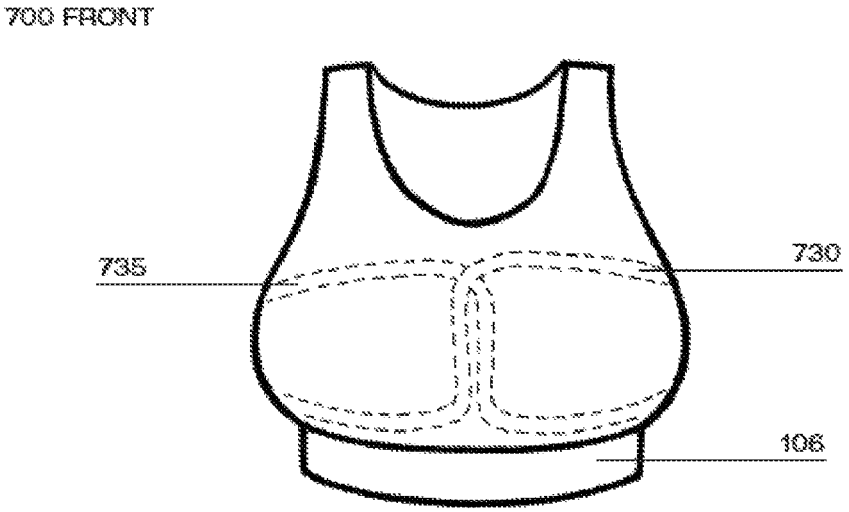
FIG. 6B is a perspective view of an embodiment of the presently described sports bra having multiple inertia neutralizing reinforcements in a crossing arrangement.

In another embodiment, as depicted in FIG. 6B, the first and second top-crossing member 730 and 735 crisscross in front of the wearer's sternum during wear. The first top-crossing member 730 forms an S-shape over the wearer's chest, with a top portion of the S-shape being disposed above the top portion of the wearer's left breast and with a bottom portion of the S-shape being disposed below the wearer's right breast. The top portion of the first top-crossing member 730 applies a downward force to counter the upward momentum of the left breast tissue during exercise. The top curve of the first top-crossing member 730 also provides a downward pressure in the center of the chest, where the cleavage would form, thereby countering the upward momentum of the more centralized breast tissue disposed between the top and bottom of the breasts. The bottom curve of the first top-crossing member 730 provides a pressure in the center of the chest, where the lower portion of the cleavage would end, thereby countering the downward momentum of the more centralized breast tissue disposed between the top and bottom of the breasts. That is, the bottom curve of the first top-crossing member 730 enhances the control provided by rib cage band 106.

Figure 7:
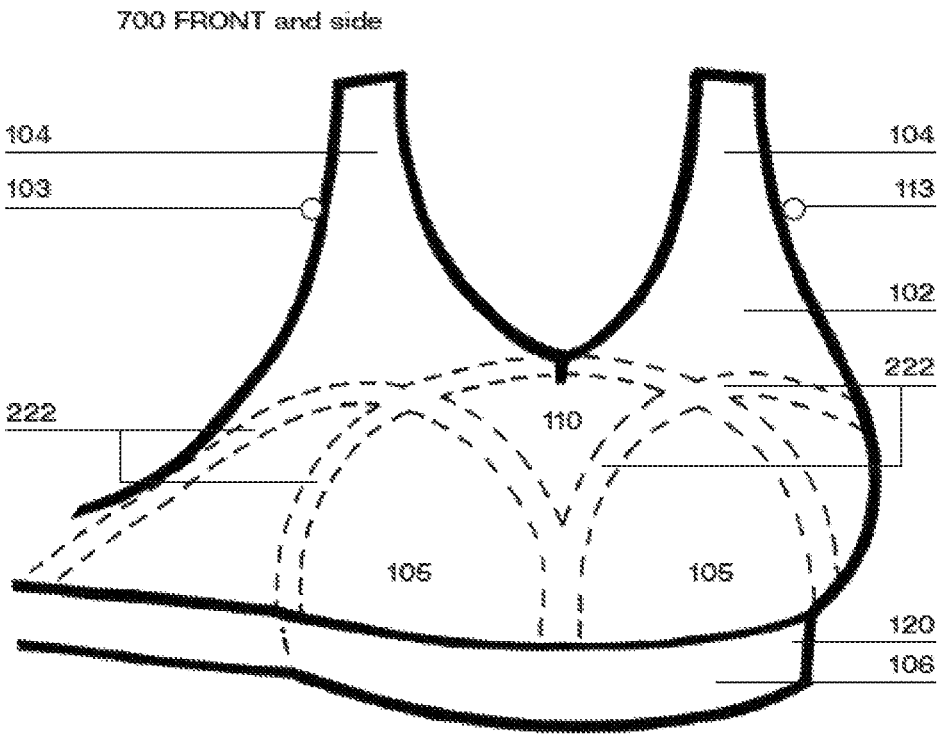
FIG. 7 is a perspective view of an embodiment of the presently described sports bra having multiple inertia neutralizing reinforcements.

In yet another embodiment, as depicted in FIG. 7, sports bra 100 can be equipped with vertical strap members in lieu of or in addition to inertia neutralizing reinforcement 220. As discussed in connection with the crisscross arrangement above, the vertical strap members can traverse each individual breast area from bra strap area 104 completely or partially down to rib cage band 106. Vertical strap members 222 can cross inertia neutralizing reinforcement 220 or can be provided in lieu of inertia neutralizing reinforcement 220. Use of vertical straps 222 can be appropriate for low impact activities such as yoga or pilates where vertical breast displacement caused by inertia of the breast weight due to impact is reduced. Other embodiments could be used without separating from the scope of this disclosure.

FIG. 7 depicts another embodiment of sports bra 100. In FIG. 7, a alternative criss-cross configuration is shown in which inertia neutralizing reinforcement 222 is arranged to provide control and breast weight movement reduction both via the horizontal placement of inertia neutralizing reinforcement 222 and an additional vertical section of inertia neutralizing reinforcement 222 substantially in a semi-circular arrangement. As shown in FIG. 7, the vertical section of inertia neutralizing reinforcement 222 can terminate at rib cage band 106 while the substantially horizontal section of inertia neutralizing reinforcement 222 extends to the back of sports bra 100 as described above with respect to the many embodiments of sports bra 100. These substantially horizontal sections of inertia neutralizing reinforcement 222 maybe continuous, contiguous or pieced as described. The other components of sports bra 100 in FIG. 7 are the same as the components previously described.

Figure 8:
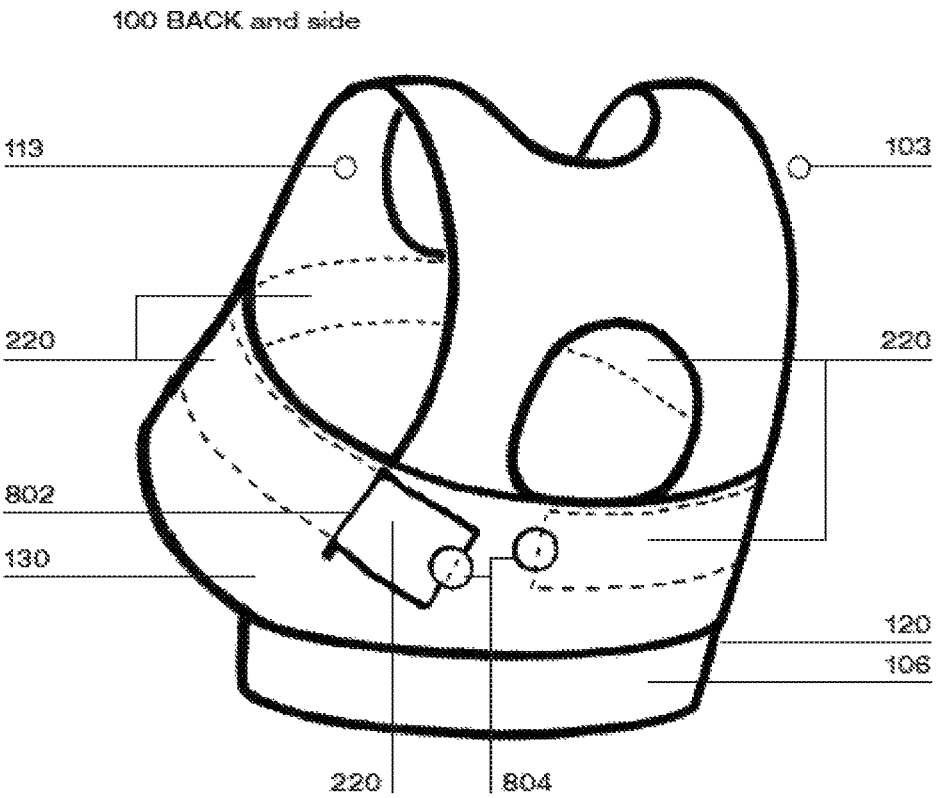
FIG. 8 is a perspective view of an embodiment of the presently described sports bra having a detachable inertia neutralizing reinforcement.

FIG. 8 depicts an embodiment of sports bra 100 in which inertia neutralizing reinforcement 220 is detachable from the body of sports bra 100. In one embodiment, inertia neutralizing reinforcement 220 is fed through one or more openings 802 within the main body section 130 of sports bra 100. Each end of inertia neutralizing reinforcement 220 can include a fastener or coupler 804 that may be a snap or other fastener allowing each halve of fastener 804 to be coupled to the other. This removability of inertia neutralizing reinforcement 220 allows for easy replacement of inertia neutralizing reinforcement 220 in the event of wear, loss of elasticity, or any other reason.

Figure 9A:
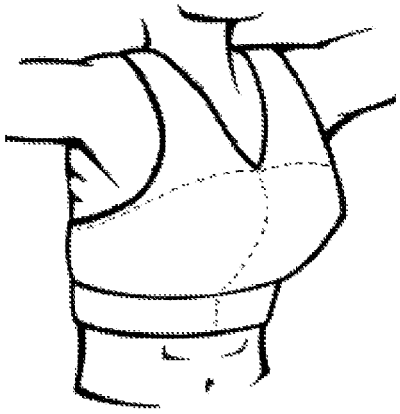
FIG. 9A is a front view of an embodiment of the presently described sports bra as worn by a user.
Figure 9B:
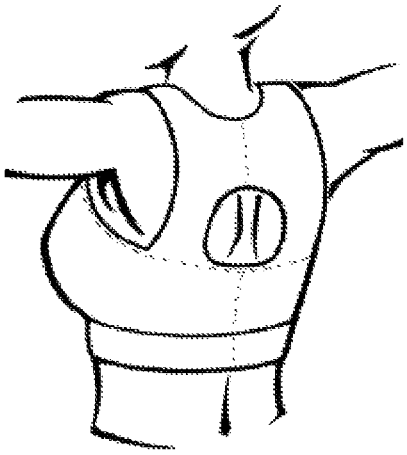
FIG. 9B is a back view of an embodiment of the presently described sports bra as worn by a user.

FIGS. 9A and 9B depict a front and back view, respectively, of an embodiment of sports bra 100 worn by a user.

Figure 1D:
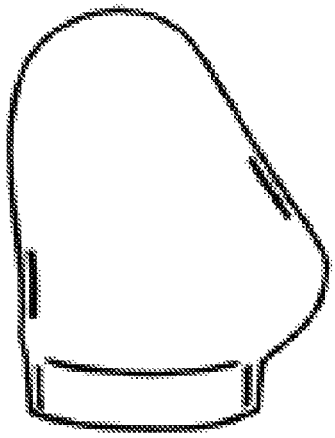
FIG. 1D is a cross-sectional view of an alternative embodiment of the presently described sports bra having an inertia neutralizing reinforcement.
Figure 1E:
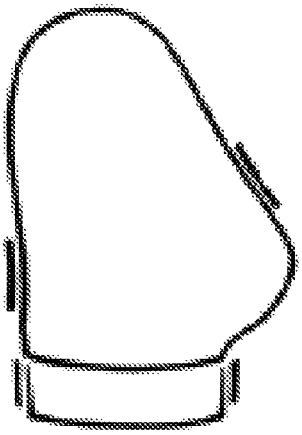
FIG. 1E is a cross-sectional view of an alternative embodiment of the presently described sports bra having an inertia neutralizing reinforcement.

Generally, inertia neutralizing reinforcement 220 can be integral to, attached to, or paired with a single layer of sports bra 100 material; under a single layer (see FIG. 1D); on top of a single layer (see FIG. 1E); contained within multiple layers; or its own element with no carrier layer (see FIG. 1C). Inertia neutralizing reinforcement 220 may be a permanent component of sports bra 100 or may be removable as described immediately above.

Although various features have been shown in the figures and described above, various changes may be made to the figures. For example, the size, shape, arrangement, and layout of components shown in the various figures are for illustration only. Each component could have any suitable size, shape, and dimension, and multiple components could have any suitable arrangement and layout or material. Also, various components depicted in the figures could be combined, further subdivided, or omitted and additional components could be added according to particular needs. Further, each component in a device or system could be implemented using any suitable structure for performing the described functions.

Although the present disclosure has been described in reference to detailed examples, those skilled in the art will understand that various changes, substitutions, variations, and improvements disclosed herein may be made without departing from the spirit and scope of the disclosure in its broadest form.

None of the description of the present disclosure should be read as implying that any particular element or function is an essential element which must be included in the claim scope: the scope of patented subject matter is defined only by the allowed claims. Moreover, none of these claims are intended to invoke paragraph six or paragraph (f) of 35 USC § 112 unless the exact words "means for" are followed by a participle.

ADDITIONAL DESCRIPTION

The following clauses are offered as further description of the disclosed invention.

Clause 1. A bra comprising:

a front panel configured to cover a front portion of a human torso, wherein the front portion of the human torso includes an area including breast tissue;

a back panel configured to cover a back portion of the human torso, the back panel coupled to the front panel;

a first upper band configured to encircle the human torso at a level approximate to a wearer's thorax and apply a downward force to the breast tissue, wherein the downward force counters an upward momentum of breast weight and inhibits upward movement of breast tissue; and a bottom band configured to encircle the human torso at a level of a bottom edge of the breast tissue and apply an upward force to the breast tissue, wherein the upward force counters a downward momentum of the breast tissue.

Clause 2. The bra of any proceeding or preceding clause, wherein the back panel further comprises moisture absorbing material.

Clause 3. The bra of any proceeding or preceding clause, wherein the front panel further comprises moisture absorbing material.

Clause 4. The bra of any proceeding or preceding clause, wherein the first upper band comprises a continuous elasticized band.

Clause 5. The bra of any proceeding or preceding clause, wherein the first upper band comprises one of more discontinuous elasticized bands.

Clause 6. The bra of any proceeding or preceding clause, wherein the upper band is further configured to at least partially encircle the back portion of the human torso at a level below the level at which the upper band encircles the front portion of the human torso.

Clause 7. The bra of any proceeding or preceding clause, wherein the front panel further comprises an interior layer and an outer layer.

Clause 8. The bra of any proceeding or preceding clause, wherein the interior layer of the front panel is manufactured from a group of materials consisting of lycra, polylycra, spandex, cotton, polyester, and wick away cotton.

Clause 9. The bra of any proceeding or preceding clause, wherein the outer layer of the front panel is manufactured from a group of materials consisting of lycra, polylycra, spandex, cotton, polyester, and wick away cotton.

Clause 10. The bra of any proceeding or preceding clause, further comprising a second upper band configured to encircle the human torso at a level approximate to a top edge of the breast tissue and apply a downward force to the breast weight, wherein the downward force counters an upward momentum of the breast weight and inhibits upward movement of the breast tissue.

What is claimed is:

1. A sports bra bra comprising:

a front panel configured to cover breast tissue on a front portion of a human torso;

a back panel configured to cover a back portion of the human torso, the back panel coupled to the front panel;

a first single contiguous upper band configured to encircle the human torso at a level on the front portion of the human torso approximate to a wearer's thorax and apply a downward force to the breast tissue, wherein the downward force counters an upward momentum of breast weight resulting from athletic activity and inhibits upward movement of breast tissue; and a bottom band configured to encircle the human torso at a level of a bottom edge of the breast tissue and apply an upward force to the breast tissue, wherein the upward force counters a downward momentum of the breast tissue, wherein the front panel further comprises an interior layer and an outer layer, wherein the first single contiguous upper band is sewn in between the interior layer and the outer layer, and wherein the first upper band is fastener-less.

2. The bra of claim 1, wherein the back panel further comprises moisture absorbing material.

3. The bra of claim 1, wherein the front panel further comprises moisture absorbing material.

4. The bra of claim 1, wherein the first single contiguous upper band comprises a continuous elasticized band.

5. The bra of claim 1, wherein the first single contiguous upper band comprises one or more continuous elasticized bands.

6. The bra of claim 1, wherein the first single contiguous upper band is further configured to at least partially encircle the back portion of the human torso at a level at which the upper band encircles the front portion of the human torso.

7. The bra of claim 1, wherein the interior layer of the front panel is manufactured from a group of materials consisting of elastane, cotton, polyester, and wick away cotton.

8. The bra of claim 1, wherein the outer layer of the front panel is manufactured from a group of materials consisting of elastane, cotton, polyester, and wick away cotton.

9. The bra of claim 1, further comprising a second upper band configured to encircle the human torso at a level approximate to a top edge of the breast tissue and apply a downward force to the breast weight, wherein the downward force counters an upward momentum of the breast weight resulting from athletic activity and inhibits upward movement of the breast tissue.

10. A sports bra bra comprising:

a front panel configured to cover breast tissue on a front portion of a human torso;

a back panel configured to cover a back portion of the human torso, the back panel coupled to the front panel;

a first single contiguous upper band configured to encircle the human torso at a level on the front portion of the human torso approximate to a wearer's thorax and apply a downward force to the breast tissue, wherein the downward force counters an upward momentum of breast weight resulting from athletic activity and inhibits upward movement of breast tissue; and a bottom band configured to encircle the human torso at a level of a bottom edge of the breast tissue and apply an upward force to the breast tissue, wherein the upward force counters a downward momentum of the breast tissue;

a second upper band configured to encircle the human torso at a level approximate to a top edge of the breast tissue and apply a downward force to the breast weight, wherein the downward force counters an upward momentum of the breast weight resulting from athletic activity and inhibits upward movement of the breast tissue, wherein the first upper band is fastener-less.

11. The bra of claim 10, wherein the back panel further comprises moisture absorbing material.

12. The bra of claim 10, wherein the front panel further comprises moisture absorbing material.

13. The bra of claim 10, wherein the first single contiguous upper band comprises a continuous elasticized band.

14. The bra of claim 10, wherein the first single contiguous upper band comprises one or more continuous elasticized bands.

15. The bra of claim 10, wherein the first single contiguous upper band is further configured to at least partially encircle the back portion of the human torso at a level at which the upper band encircles the front portion of the human torso.

16. The bra of claim 10, wherein the front panel further comprises an interior layer and an outer layer, wherein the first single contiguous upper band is sewn in between the interior layer and the outer layer.

17. The bra of claim 16, wherein the interior layer of the front panel is manufactured from a group of materials consisting of elastane, cotton, polyester, and wick away cotton.

18. The bra of claim 16, wherein the outer layer of the front panel is manufactured from a group of materials consisting of elastane, cotton, polyester, and wick away cotton.

* * * * *